United States Patent [19]

Horng

[11] Patent Number: 4,787,863

[45] Date of Patent: Nov. 29, 1988

[54] PLUG STRUCTURE FOR VENTILATING FANS

[76] Inventor: Alex Horng, No. 149, Yi Yung Rd., Kaohsiung, Taiwan, 800

[21] Appl. No.: 51,617

[22] Filed: May 20, 1987

[51] Int. Cl.[4] ..... H01R 19/16

[52] U.S. Cl. ..... 439/557; 439/695

[58] Field of Search ..... 439/557, 695, 718, 901–906, 439/701, 712, 567, 558

[56] References Cited

U.S. PATENT DOCUMENTS

| | | | |
|---|---|---|---|
| 3,569,917 | 3/1971 | Vlijmen | 439/689 |
| 4,097,109 | 6/1978 | Cross | 439/557 |
| 4,460,233 | 7/1984 | Newton et al. | 439/557 |
| 4,673,239 | 6/1987 | Smith et al. | 439/746 |
| 4,702,542 | 10/1987 | Noyes | 439/557 |

FOREIGN PATENT DOCUMENTS

| | | | |
|---|---|---|---|
| 0570717 | 12/1975 | Switzerland | 439/557 |
| 1394867 | 5/1975 | United Kingdom | 439/557 |

*Primary Examiner*—Gil Weidenfeld
*Assistant Examiner*—Gary F. Paumen
*Attorney, Agent, or Firm*—Holman & Stern

[57] ABSTRACT

This invention concerns a plug structure of a ventilating fan which can be easily checked out to determine if the connection is correct or not. A base for carrying electric blades connected with a cord is combined with a plate in a corner of the fan body by pushing it on the plate by means of the combination of partition walls and a slot. The plug is easy to assemble with or to take off the fan body for checking.

2 Claims, 4 Drawing Sheets

PLUG STRUCTURE FOR VENTILATING FANS

BACKGROUND OF THE INVENTION

What is concerned in this invention directs to a ventilating fan used in business machines, electric appliances, precise machines, etc. The conventional fan, as shown in FIG. 11, requires a cavity on its shell base for a plug with metallic blades to be inserted into, and the blades are usually associated with a cord previously so that electric power can reach to the coil of the motor.

As the cavity is fixed in its location and hidden or invisible, the insertion of the metallic blades and the plug often bends the cord or makes the blades drop off. And such defects are not easy to be checked out. Therefore, it quite often happens that the fan after being fixed in a machine may be found to be out of order. This not only causes a lot of inconvenience but influences the life of the machine. So this invention has been made to improve the above-mentioned defects.

SUMMARY OF THE INVENTION

This invention concerns a plug structure of a ventilating fan whose body has a plate and two partition walls at each of its two side walls on the plate. A recess is formed between the two partition walls and a projection at its bottom extends inwards. A hole is set below the projection. A base has a slot able to match into the partition walls so that a hook of the slot can hook up with the projection, and cavities provided for locating blades connected with a power cord. A cover is to be put on the base.

DETAILED DESCRIPTION OF THE INVENTION

Figure 1:
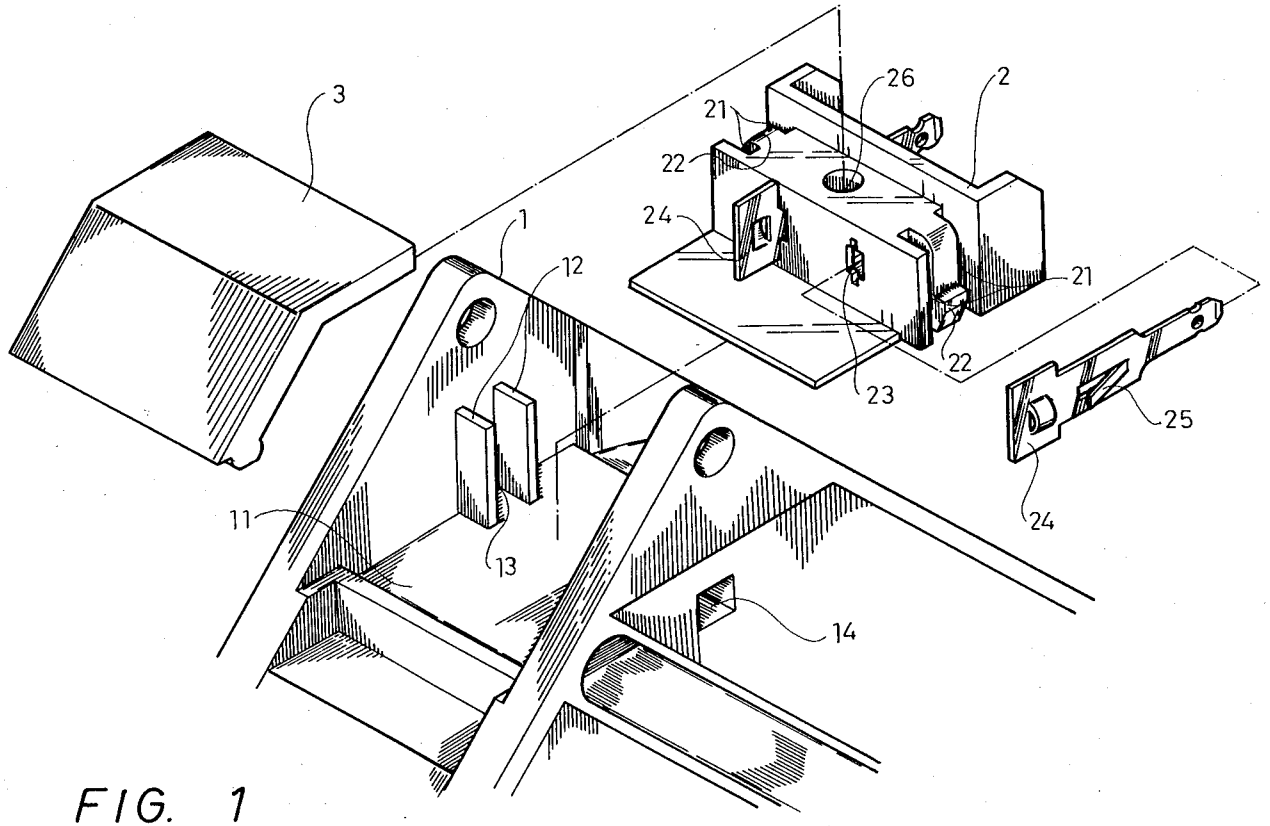
FIG. 1 is a general view of the plug structure for ventilating fans in this invention.
Figure 2:
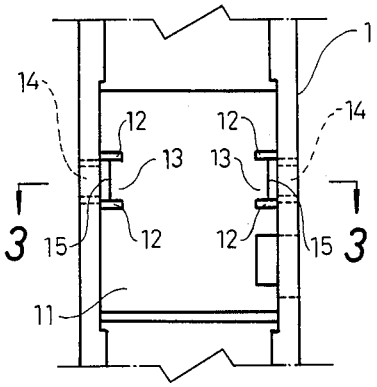
FIG. 2 is a structural view of a corner of the fan body in this invention.
Figure 3:
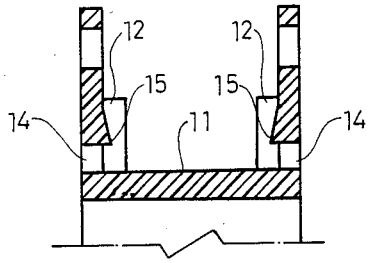
FIG. 3 is a cross-sectional view of 3—3 line on FIG. 2.

First of all, as shown in FIG. 1, this invention includes main body 1 with plate 11 set at its corner. On the two walls of main body 1 beside the plate 11, there are respectively set two partition walls 12, which form recess 13 between them. Hole 14 is bored at each bottom of recess 13 and projections 15 (FIG. 9) projecting inwards is provided adjacent hole 14.

Figure 4:
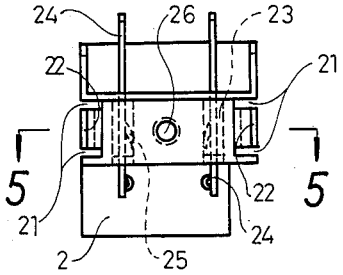
FIG. 4 is a structural view of the base in this invention.
Figure 5:
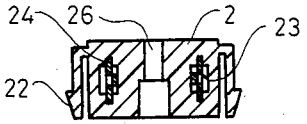
FIG. 5 is a cross-sectional view of 5—5 line on FIG. 4.

Next, as shown in FIGS. 1, 4, 5, base 2 is set with slots 21 respectively at its two sides, to engage with the outside of partition walls 12 and has at its center a hook 22 connecting with the base 2 at its top. Hook 22 can slide downwardly over projection 15 to lock at the bottom of projection 15.

Base 2 has, in addition, two cavities 23 which are respectively formed as a gradually increased opening from its entrance to its exit so that blades 24 can be stopped at its entrance after being inserted through cavities 23. Blade 24 each have a stopping pin 25 extending outwards to engage the entrance wall when blades 24 are inserted into cavities 23 so as to prevent the blades from loosening. Hole 26 in the top 6 base 2 has a smaller diameter at its top than that at its bottom so that a pin 31 of cover 3 can snap into hole 26.

Figure 6:
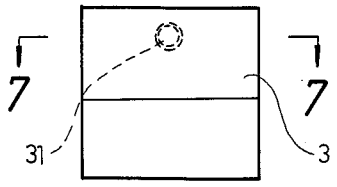
FIG. 6 is a structural view of the cover in this invention.
Figure 7:
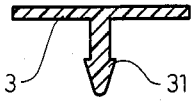
FIG. 7 is a cross-sectional view of 7—7 line on FIG. 6.

In addition, as shown in FIGS. 1, 6, 7 pin 31 that can insert into hole 26 of base 2 has a reverse cone-shaped front with a diameter a bit smaller than that of hole 26 so that rod 31 can smoothly insert into hole 26 for locking the cover.

Figure 8:
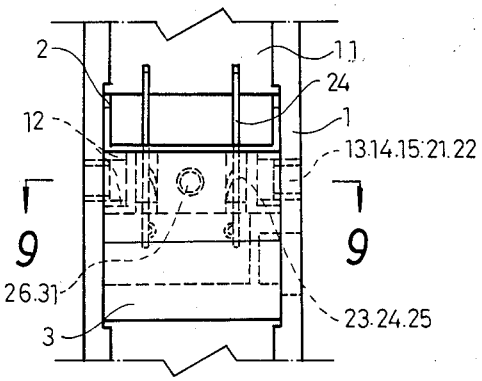
FIG. 8 is a top view of this plug structure combined with the fan body in this invention.
Figure 9:
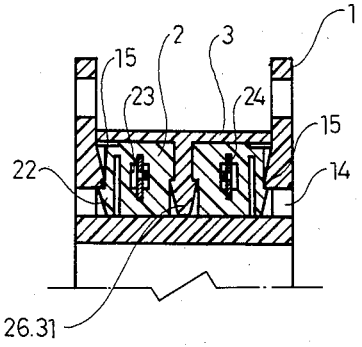
FIG. 9 is a cross-sectional view of 9—9 line on FIG. 8.
Figure 10:
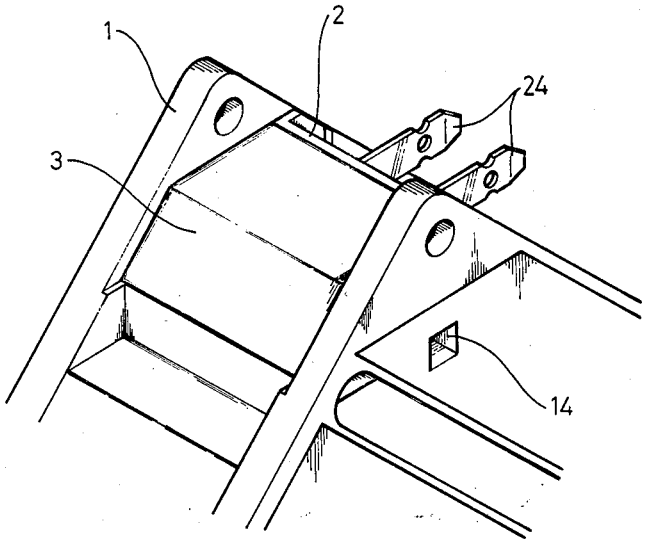
FIG. 10 is an outside view of this invention.
Figure 11:
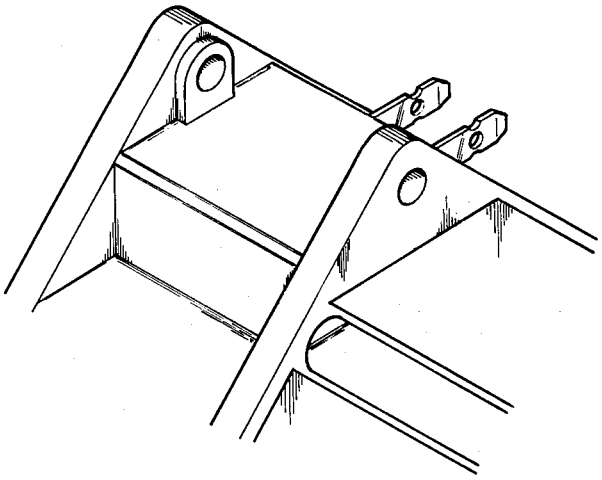
FIG. 11 (PRIOR ART)
FIG. 11 is an outside view of conventional plug structure of ventilating fans.

FIGS. 8, 9 illustrate the assembly of this invention. By inserting slot 21 of base 2 into partition walls 12 of main body 1 hook 22 can lock at the bottom of hump 15. And if necessary, by pressing the hook 22 through hole 14, base 2 can be taken off main body 1. Also blades 24 connected with a cord assembled in base 2 can be quickly checked out if they are connected correctly or not. If correct, cover 3 can be pressed down to make pin 31 lock in hole 26 of base 2 in a solid state as shown in FIG. 10.

Conclusively, this invention has a simple structure and is easy to be assembled together without fear of loosening off. And the connecting condition of the cord and the blades can easily and correctly be checked out, diminishing the failure rate.

What is claimed is:

1. A plug structure for a ventilating fan comprising:

a main body having a base plate in one corner thereof and two sidewalls on the base plate, two partition walls extending inwardly from each sidewall, a recess formed between the two partition walls, an inwardly extending projection adjacent the bottom of each said recess, and a hole in each sidewall below said projection;

a base for fitting on the main body between said sidewalls, the base having opposite sides with slots to mate with said partition walls and depressible hooks between the respective slots to releasably engage the respective projections, the hooks being accessible for release through the holes in the respective sidewalls, electrical connector blades set in apertures in the base extending transversely to the slots, and a round hole in the base extending parallel to the slots for connection of a cover; and a cover for covering the base, the cover having a pin protruding downwardly for inserting into said round hole of the base, the pin having engagement means for retaining same in the round hole.

2. A plug structure as defined in claim 1 wherein:

the electrical connector blades include spring fingers retaining same in the respective apertures.

* * * * *